US007569007B2

(12) United States Patent
Thoma

(10) Patent No.: US 7,569,007 B2
(45) Date of Patent: Aug. 4, 2009

(54) METHOD FOR CONTROLLING OR REGULATING A FOLDER OF A PRINTING PRESS

(75) Inventor: August Thoma, Bonstetten (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 11/363,399

(22) Filed: Feb. 27, 2006

(65) Prior Publication Data

US 2006/0199718 A1 Sep. 7, 2006

(30) Foreign Application Priority Data

Mar. 1, 2005 (DE) ..... 10 2005 009 132

(51) Int. Cl.
*B31B 1/00* (2006.01)

(52) U.S. Cl. ..... 493/23; 493/11; 493/34

(58) Field of Classification Search ..... 493/23, 493/432, 11, 37, 417, 34
See application file for complete search history.

(56) References Cited

U.S. PATENT DOCUMENTS

| | | | | |
|---|---|---|---|---|
| 4,363,271 | A * | 12/1982 | Horst | 101/181 |
| 4,467,949 | A * | 8/1984 | Nakata | 226/45 |
| 4,578,052 | A | 3/1986 | Engel et al. | |
| 4,974,077 | A * | 11/1990 | Kusaba | 382/141 |
| 5,030,192 | A * | 7/1991 | Sager | 493/414 |
| 5,683,338 | A * | 11/1997 | Krasuski et al. | 493/23 |
| 5,818,719 | A * | 10/1998 | Brandon et al. | 700/125 |
| 6,024,682 | A | 2/2000 | Mandel et al. | |
| 6,086,522 | A * | 7/2000 | Hechler | 493/23 |
| 6,306,072 | B1 * | 10/2001 | Honegger | 493/364 |
| 6,319,182 | B1 * | 11/2001 | Schneider | 493/10 |
| 6,641,514 | B1 | 11/2003 | Hechler | |
| 6,935,998 | B2 | 8/2005 | Silvestre | |
| 2002/0113977 | A1 | 8/2002 | Silvestre | |
| 2005/0090373 | A1 | 4/2005 | Schmid et al. | |
| 2006/0217253 | A1 * | 9/2006 | Thoma | 493/432 |

FOREIGN PATENT DOCUMENTS

| | | |
|---|---|---|
| DE | 32 34 148 | 6/1983 |
| DE | 100 63 528 | 2/2003 |
| DE | 1003 50 405 | 6/2005 |
| JP | 05309828 | 11/1993 |
| JP | 07-041247 | 10/1995 |
| JP | 10-157080 | 6/1998 |
| JP | 10217431 | 8/1998 |
| JP | 2001-171908 | 6/2001 |

OTHER PUBLICATIONS

British Search Report dated Jun. 20, 2006 issued in corresponding foreign application No. GB0603994.5.
Computed generated English translation of JP 2001-171908.

* cited by examiner

*Primary Examiner*—Sameh H. Tawfik
(74) *Attorney, Agent, or Firm*—Cohen Pontani Lieberman & Pavane LLP

(57) ABSTRACT

A method for controlling or regulating a folder of a printing press in which at least one fold control mark is printed onto a printed copy or a printing material of the printed copy. The at least one printed fold control mark is measured and at least one fold actual measured value is compared with a corresponding fold setpoint value. The folder is then set automatically as a function of the comparison between the fold actual measured value and the fold setpoint value, such that the fold actual measured value corresponds to the fold setpoint value or is approximated to it in subsequent printed copies.

10 Claims, 1 Drawing Sheet

METHOD FOR CONTROLLING OR REGULATING A FOLDER OF A PRINTING PRESS

BACKGROUND OF THE INVENTION

The present invention relates to a method for controlling or regulating a folder of a printing press. The present invention also relates to a printing press having at least one printing unit for printing an unfolded printing material of a printed copy and having at least one folder for folding the printing material to provide the printed copy.

Folders of printing presses serve to form folds on printed printing materials. According to the prior art, a web-shaped printing material which has not yet been severed is guided through what is known as a folding former for formation of a longitudinal fold to be formed on the web-shaped printing material. Starting from the folding former, the web-shaped printing material is transported via several pull rolls in the direction of a cutting knife cylinder and a folding blade cylinder which interacts with the cutting knife cylinder. Copies are severed from the web-shaped printing material on the cutting knife cylinder and are moved in the direction of a folding jaw cylinder with the aid of the folding blade cylinder. The copy which is severed from the web-shaped printing material on the cutting knife cylinder and is moved in the direction of the folding jaw cylinder by the folding blade cylinder is transferred to the folding jaw cylinder with formation of a first crossfold by the folding blade cylinder. Further, second crossfolds may be formed between the folding jaw cylinder and a gripper cylinder which interacts with the latter. The printed copy which has been provided in this way with a longitudinal fold and crossfolds can then be provided with second longitudinal folds while still in the region of a folding table which is connected behind the gripper cylinder, the second longitudinal folds running parallel to the longitudinal fold which was formed in the folding former.

If the fold formation is to be checked according to the prior art, a folded printed copy is removed from a printing press, unfolded and examined in the unfolded state by a printer. If the printer notices here that folds run obliquely, actuators for the folding former and/or the folding blade cylinder and/or the folding jaw cylinder and/or the folding table are adjusted manually by the printer such that the desired fold is formed on subsequent printed copies. Here, the procedure is purely empirical according to the prior art, with the result that there are no reproducible results during the adjustment of the folder which is performed by the printer.

BRIEF SUMMARY OF THE INVENTION

An object of the present invention is to provide a method for controlling or regulating a folder of a printing press which overcomes the problems of the prior art and to provide a printing press with a folder which overcomes the problems of the prior art.

The object is met by a method for controlling or regulating a folder of a printing press in which at least one fold control mark is printed onto a printed copy or a printing material of the printed copy. The at least one printed fold control mark is measured and at least one fold actual measured value is compared with a corresponding fold setpoint value. The folder is then set automatically as a function of the comparison between the fold actual measured value and the fold setpoint value, such that the fold actual measured value corresponds to the fold setpoint value or is approximated to it in subsequent printed copies.

The fold control marks may be printed before and/or after folding and are preferably printed with printing inks which are invisible to the human eye, in particular with fluorescent printing inks.

The object of the present invention is also met by a printing press having at least one printing unit for printing an unfolded printing material of a printed copy, a folder for folding the printing material in order to provide the printed copy, and a control device or regulating device for controlling or regulating the folder in accordance with the above described method.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
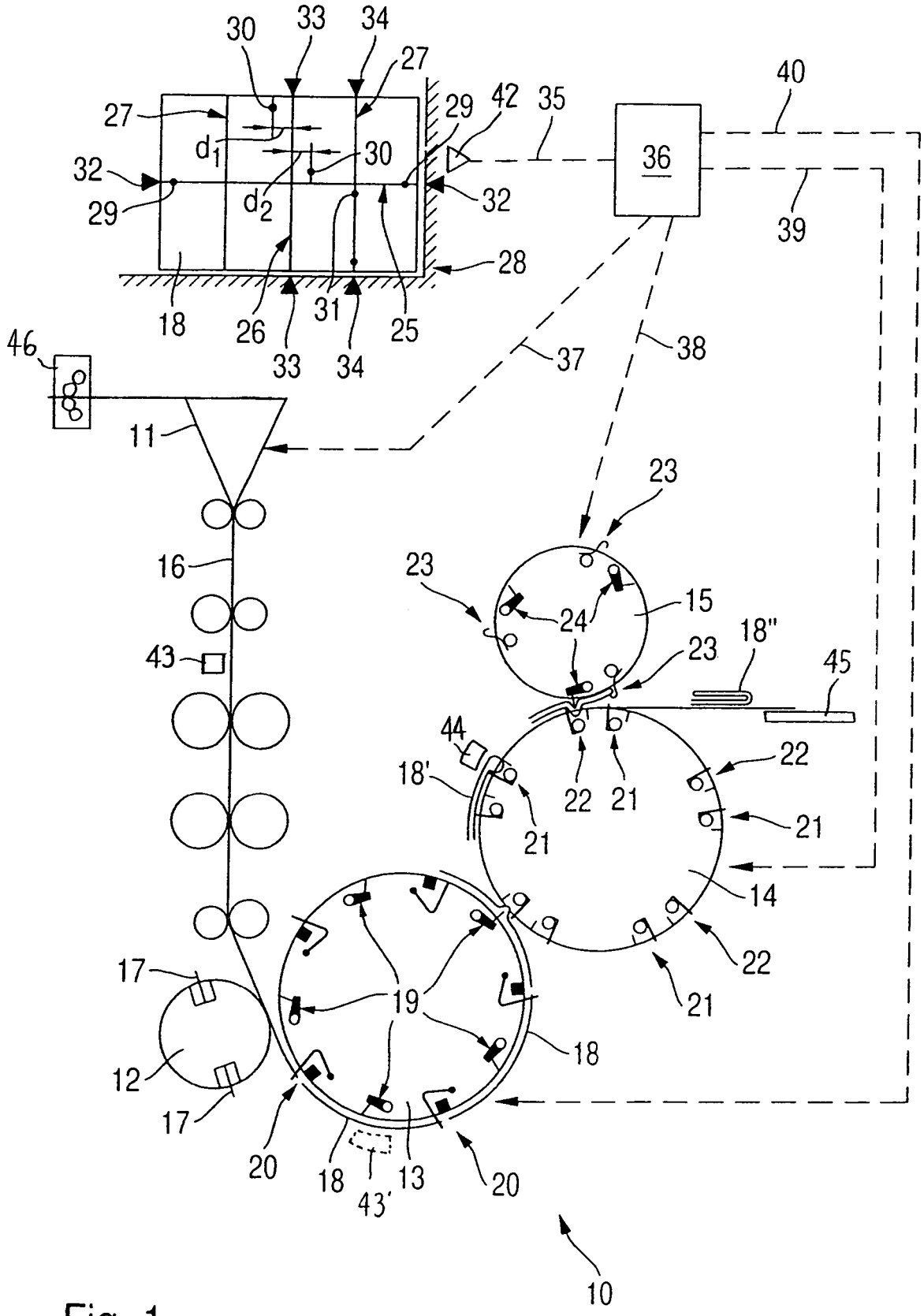
FIG. 1 is a schematic diagram of a folder of a printing press according to an embodiment of the present invention.

The principle method of operation of folders is known to the expert addressed here and therefore does not require a detailed explanation. FIG. 1 shows a typical folder 10 for a printing press. As is usual, the folder 10 comprises a folding former 11, a cutting knife cylinder 12, a folding blade cylinder 13, a folding jaw cylinder 14 and a gripper cylinder 15. A printing material 16 is moved or guided through the folder 10. A first longitudinal fold is produced in the region of the folding former 11 and a first crossfold is produced in the region between the folding blade cylinder 13 and the folding jaw cylinder 14. In the exemplary embodiment shown, second crossfolds are produced between the folding jaw cylinder 14 and the gripper cylinder 15. A folding table 45 (shown schematically) may be arranged after or downstream of the gripper cylinder 15, to produce second longitudinal folds which run parallel to the longitudinal fold produced in the folding former 11.

The cutting knife cylinder 12 comprises at least one cutting knife 17 which is used to cut copies 18 from the printing material 16 which has been prefolded with a longitudinal fold in the region of the folding former 11. The folding blade cylinder 13 comprises folding blades 19 and perforating needles 20. The folding jaw cylinder 14 has folding jaws 21, 22 and the gripper cylinder 15 has grippers 23 and folding blades 24.

To provide a first crossfold, the cutting knife cylinder 12, the folding blade cylinder 13 and the folding jaw cylinder 14 interact such that, when a copy 18 is severed from the printing material 16 with the aid of the cutting knife 17 of the cutting knife cylinder 12, the severed copy 18 is held at the start of the sheet by a perforating needle 20 and is moved further by rotation of the folding blade cylinder 13. As a result, the severed copy 18 is moved into a relative position between the folding blade cylinder 13 and the folding jaw cylinder 14, which relative position is defined for the formation of the first crossfold. A folding blade 19 of the folding blade cylinder 13 presses the copy 18 between opened first folding jaws 21 of the folding jaw cylinder 14 when this relative position is reached, whereas the perforating needle 20 releases the copy 18. A copy 18' which has thus been provided with the first crossfold and is held by the folding jaw cylinder 14 is then moved further in the direction of the gripper cylinder 15 by rotation of the folding jaw cylinder 14.

In the exemplary embodiment of FIG. 1, at least one second crossfold is formed between the folding jaw cylinder 14 and the gripper cylinder 15. To accomplish this, a copy 18' which is provided with the first crossfold is moved into a defined relative position between the folding jaw cylinder 14 and the gripper cylinder 15, the first folding jaw 21 of the folding jaw cylinder 14 being opened in this relative position. A gripper 23 of the gripper cylinder 15 grips that section of the copy 18' which is released by the first folding jaw 21 and a folding blade 24 of the gripper cylinder 15 presses the copy 18' between an opened second folding jaw 22 of the folding jaw cylinder 14. A copy 18" thus provided with first and second crossfolds is subsequently released from the folding jaw cylinder 14 and fed to a further processing step, for example the formation of second longitudinal folds in the region of the folding table 45.

The folding blades 19 and perforating needles 20 form the adjusting devices of the folding blade cylinder 13. The folding jaws 21 and 22 form the adjusting devices of the folding jaw cylinder 14. The grippers 23 and folding blades 24 form the adjusting devices of the gripper cylinder 15. These adjusting devices can be activated via control cams (not shown), it being possible for the control cams to be adjusted relative to one another in order to set the number and/or type of the crossfolds which are to be formed. The adjusting devices of the folding former 11 are offset bars, with the aid of which the position of the folding former 11 can be oriented relative to the printing material 16 and the formation of the longitudinal fold in the region of the folding former 11 can thus be influenced. The folding table 45 likewise has adjusting devices for influencing the formation of the second longitudinal folds in the region of the folding table.

In the context of the present invention, at least one fold control mark is printed onto a printed copy or onto the printing material before and/or after it has been folded. The or every printed fold control mark is measured and at least one fold actual value is obtained here. Each fold actual value is compared with a corresponding fold setpoint value. At least one adjusting device of the folder is then set automatically as a function of this comparison, such that the deviation between the fold actual value and the fold setpoint value decreases in subsequent printed copies and accordingly the fold actual value is approximated to the fold setpoint value.

FIG. 1 shows an unfolded printed copy 18 which has been provided in the region of the folding former 11 with a longitudinal fold 25, in the region of the folding jaw cylinder 14 with a first crossfold 26 and in the region of the gripper cylinder 15 with two second crossfolds 27. The unfolded copy is positioned on a support 28 to obtain measurements of the unfolded printed copy 18.

In the exemplary embodiment shown, fold control marks 29, 30 and 31 are printed on the printed copy 18. More specifically, fold control marks 29 are printed for the longitudinal fold 25, fold control marks 30 are printed for the first crossfold 26 and fold control marks 31 are printed for the second crossfold 27. The support 28 for the unfolded or folded-open printed copy 18 has what are known as zero marks 32, 33 and 34 which serve to orient the unfolded printed copy 18 on the support 28 and to define setpoint values for the longitudinal fold and the crossfolds. The zero marks 32 define setpoint values for the longitudinal fold 25. The zero marks 33 and 34 define setpoint values for the crossfolds 26 and 27, respectively.

During the measuring of the unfolded or folded-open printed copy 18 using sensor 42, measured values, i.e., fold actual values, are transmitted to a control device 36 in the direction of the arrow 35, a check being made in the control device 36 as to whether there is a deviation between a fold actual value and a fold setpoint value. FIG. 1 indicates a deviation between the fold actual value and the fold setpoint value for the first crossfold 26, the deviation between the fold actual value and the fold setpoint value resulting from the distance $d_1$ and $d_2$ between the fold control marks 30 and from the fold setpoint value for the first crossfold 26 which is defined by the zero marks 33.

In the context of the present invention, adjusting signals are generated automatically in the control device 36 for the automatic adjustment of the folder 10 as a function of the deviation between a measured fold actual value and a predefined fold setpoint value for the longitudinal fold and the crossfolds. FIG. 1 thus uses the arrows 37, 38, 39 and 40 to show adjusting signals which are produced by the control device 36 for the adjustment of the folding former 11, the folding blade cylinder 13, the folding jaw cylinder 14 and the gripper cylinder 15, in order to adjust the folder 10 automatically in the event of a detected deviation between a fold actual value and a fold setpoint value.

In the context of the present invention, the fold control marks are printed onto the printing material 16 or the printed copy 18 before and/or after the respective folding step is performed. The fold control marks 29 which serve to check the longitudinal fold 25 which is produced in the folding former 11 are preferably printed onto the printing material 16 in a printing unit 46 which is mounted ahead of the folding former 11, before the longitudinal fold is produced. After the longitudinal fold is produced in the folding former 11, in the context of the present invention, the fold control marks 30 which serve to check the first crossfold 26 which is produced in the region of the folding jaw cylinder 14 are printed onto the printing material 16 or a printed copy 18' which is severed from the printing material and folded partially. A corresponding printing device (43 or 43') for printing the fold control marks 30 is accordingly connected behind the folding former 11 and in front of the folding jaw cylinder 14 and is accordingly integrated into the folder 10. The fold control marks 30 for checking the first crossfold 26 which is produced in the region of the folding jaw cylinder 14 are accordingly printed onto the printing material in the folder 10. A printing device 44 for printing the fold control marks 31 for checking the second crossfolds 27 is arranged upstream of gripper cylinder 15.

Although it is preferred to print the fold control marks onto the printing material 16 or the printed copy 18 before the respective folding step is carried out, the fold control marks can also be applied to the printing material 16 or the printed copy 18 after the respective folding step is carried out.

In the exemplary embodiment which is described with reference to FIG. 1, the fold control marks are measured outside the folder after the printed copy is unfolded. It is to be pointed out that the fold control marks may alternatively be measured within the folder. The corresponding sensors 42 then have to be integrated into the folder. Although this is more complex in hardware terms, it permits a more rapid reaction to faulty folds.

According to our embodiment of the present invention, the fold control marks are printed onto the printing material with a printing ink which is invisible to the human eye. Here, fluorescent printing inks are preferably used which can be detected with corresponding sensors in the region of the support. The application of the fold control marks with a printing ink which is invisible to the human eye can avoid the situation where the printed product which is to be produced is impaired negatively in a visual manner by the fold control marks.

The present invention proposes for the first time an automated system for measuring folds which have been produced in a folder and for setting the folder automatically as a function of the measured result. As a result, it is possible for the first time to produce reproducible results during the adjustment of the folder as a function of measured results which represent the quality of folds which are produced in the folder.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for controlling or regulating a folder of a printing press, comprising the steps of:

printing at least one fold control mark onto a printed copy or a printing material of the printed copy;

folding the printed copy or the printing material of the printed copy in the folder, thereby creating at least one actual fold, said step of printing comprising printing at least one fold control mark at least one of before and after each said step of folding, and said step of printing further comprising printing first fold control marks onto the printed copy or the printing material of the printed copy in an unfolded state, and printing second fold control marks onto the printed copy in a partly folded state;

after said step of folding, measuring the at least one fold control mark and obtaining at least one fold actual value from the at least one actual fold;

comparing the at least one fold actual value with a corresponding fold setpoint value, the corresponding fold setpoint value being associated with one of the at least one fold control mark; and automatically setting an adjusting device of the folder based on the results of said step of comparing the fold actual value to the fold setpoint value, such that the fold actual value in subsequent printed copies corresponds to or is approximated to the fold setpoint value.

2. The method of claim 1, wherein the first fold control marks are printed in printing units of the printing press.

3. The method of claim 2, wherein the second fold control marks are printed in the folder.

4. The method of claim 1, wherein the second fold control marks are printed in the folder

5. The method of claim 1, wherein the folder control marks are printed with printing inks which are invisible to the human eye.

6. the method of claim 1, wherein the folder control marks are printed with printing inks.

7. The method of claim 1, wherein said of setting comprises automatically setting at least one of a folding former, a folding blade cylinder, a folding jaw cylinder, a gripper cylinder, or a folding table of the folder as a function of said step of comparing.

8. The method of claim 1, further comprising the steps of removing one folded printed copy from a printing press, subsequently unfolding or folding open the removed copy, positioning the unfolded or folded open removed copy on a support, and performing said step of measuring on the copy on the support.

9. The method of claim 8, wherein the step of positioning comprises aligning the at least one actual fold with at least one zero mark on the support.

10. The method of claim 1, wherein said step of measuring is performed in the folder.

* * * * *